United States Patent [19]

Garden

[11] 4,116,329

[45] Sep. 26, 1978

[54] SAFETY CONTAINER HAVING VENT MEANS

[76] Inventor: Barrie Franklin Garden, Kilgour St., Seacliff via Dunedin, New Zealand

[21] Appl. No.: 860,227

[22] Filed: Dec. 13, 1977

[30] Foreign Application Priority Data

Dec. 21, 1976 [NZ] New Zealand ..... 182939

[51] Int. Cl.[2] ..... A45C 13/10; A45C 13/18

[52] U.S. Cl. ..... 206/1.5; 215/201; 220/8; 220/367

[58] Field of Search ..... 206/1.5, 530, 807, 540; 215/223, 201, 206; 220/8, 366, 367

[56] References Cited

U.S. PATENT DOCUMENTS

| | | | |
|---|---|---|---|
| 3,677,396 | 7/1972 | Staar | 206/1.5 X |
| 3,828,961 | 8/1974 | Lewis | 215/223 |
| 3,844,407 | 10/1974 | Buie | 220/8 X |
| 3,912,073 | 10/1975 | Lewis | 206/1.5 |
| 3,968,871 | 7/1976 | Briscoe | 206/1.5 |

*Primary Examiner*—George T. Hall
*Attorney, Agent, or Firm*—Holman & Stern

[57] ABSTRACT

A childproof container for particulate substances such as pills, tablets or the like, air being expelled from the interior of the container when the container is closed whereupon atmospheric pressure prevents the container from being opened again until the interior is vented to atmosphere in the prescribed manner.

13 Claims, 3 Drawing Figures

FIG 1
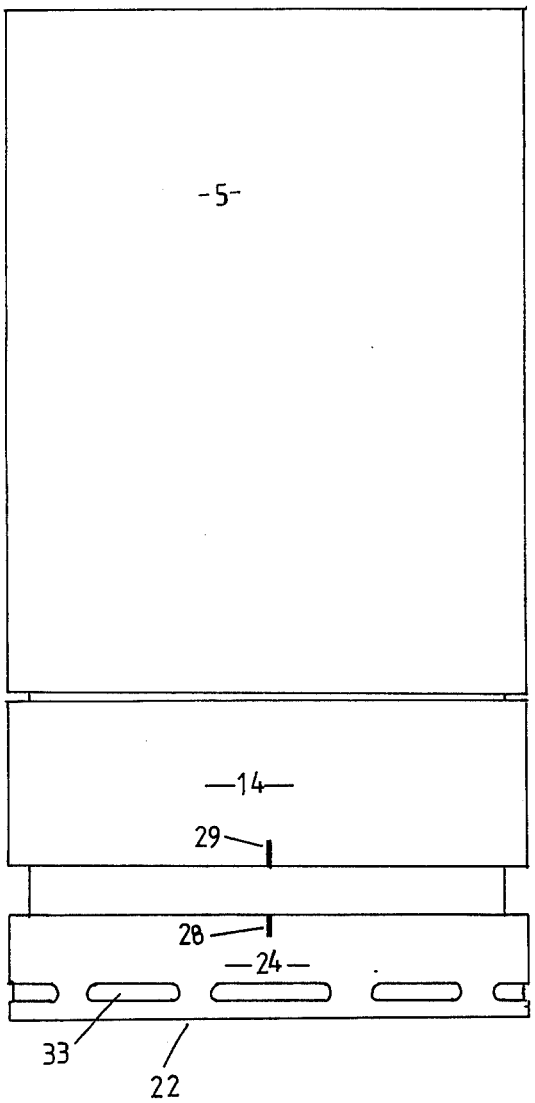
FIG 2
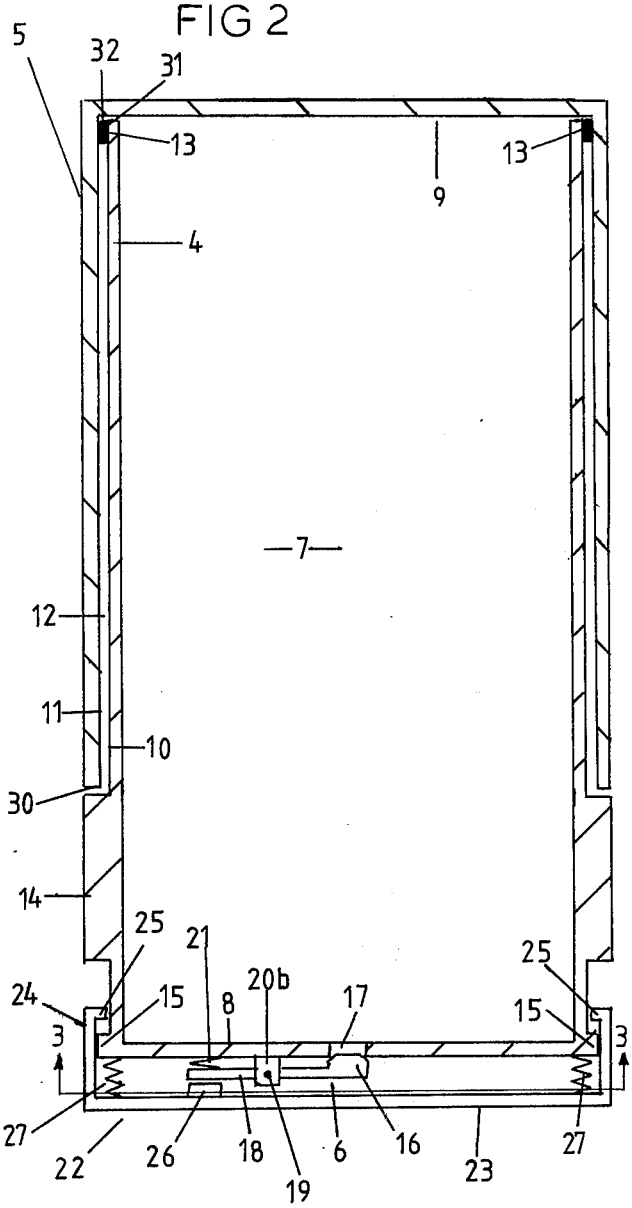
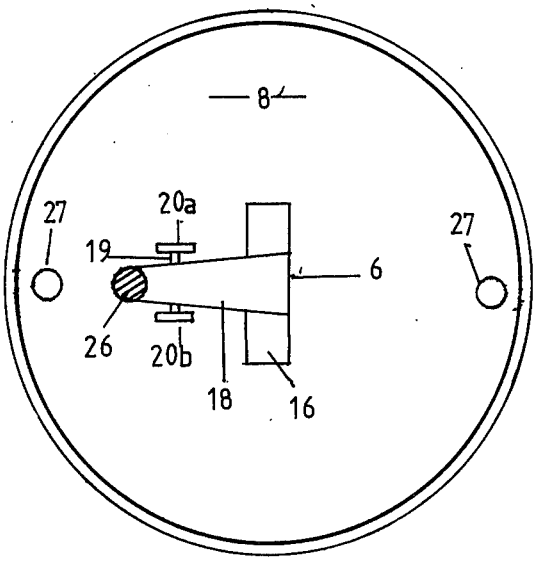
FIG 3

SAFETY CONTAINER HAVING VENT MEANS

BACKGROUND OF THE INVENTION

1. Field of the Invention

This invention relates to containers and in particular to containers adapted so that persons such as children could not, without instruction, open the same.

2. Description of the Prior Art

Childproof containers are well known. Many embodiments of such containers have been developed utilizing a conventional container with a specialised closure. The closure might comprise a two piece cap wherein an outer portion is displaced in a particular manner so as to engage an inner portion which is usually fitted to a screw threaded neck on a conventional bottle or the like in the known manner. British Pat. No. 1,122,606 to Arton Industries Inc., British Pat. No. 1,142,907 to Roberts and Rankin, U.S. Pat. No. 2,487,728 to Quiring and U.S. Pat. No. 3,669,294 to Petronelli & Park disclose examples of containers which include such a principle.

While the above caps enable containers to be closed against infants and thus achieve the desired object, such caps commonly require intricate and expensive tooling to produce which has a resulting influence on the unit cost of the product. Furthermore, it is often difficult for aged or infirmed persons to manipulate the caps and thus gain access to the contents of the container.

It is an object of the present invention to provide a container which is relatively easy to manufacture and relatively easy to open, upon following the prescribed manner of operation.

It is a further object of the invention to provide a container which does not rely on intricate physical interengagement of components in order to prevent persons such as children from gaining access to the interior thereof.

SUMMARY OF THE INVENTION

The present invention provides a container comprising two components which when combined define an enclosed space in which discrete objects such as pills, tablets or the like may be contained. As the two components are placed in combination at least a portion of the air within the enclosed space is expelled through a valve means included in one of the components, which valve means thereafter remains closed and any attempt to disassociate the two components defining the enclosed space is resisted by atmospheric pressure. Access may only be gained to the interior of the container by venting the interior to atmosphere, which operation is preferably effected by over-riding the valve means. This latter mentioned operation preferably requires following a prescribed series of operations, whereupon the interior of the container is vented to atmosphere and the two components forming the container proper may be disassociated and access gained to the contents therein.

The valve means is included in one or other of the components which in combination with the other defines the enclosed space and is preferably in the form of a simple flap valve which is automatically actuated when subjected to air pressure on one side thereof, but which will not allow the passage of air in the reverse direction unless over-ridden by a further operation. As an additional feature, a container according to the invention preferably further includes means to trigger the aforementioned valve means, this latter mentioned means ensuring that the valve means may only be overridden and thus the container opened when the triggering means is manipulated in the prescribed manner.

Preferably the triggering means comprises a further component mounted over the valve means on that component which includes the valve means, the triggering component being displaceable relative to the means including the valve means such that when it is desired to gain access to the interior of the container, the valve triggering component may be displaced into the opening position and the valve over-ridden to vent the interior of the container to atmosphere.

BRIEF DESCRIPTION OF THE DRAWINGS

One embodiment of the invention will now be described with reference to the accompanying drawings in which:

FIG. 1 shows an external elevational view of a container according to the invention;

FIG. 2 depicts a cross-sectional elevational view of the container depicted in FIG. 1, and FIG. 3 depicts a view along the line 3—3 in FIG. 2.

DETAILED DESCRIPTION OF THE PREFERRED EMBODIMENT

A container according to the invention and depicted in the accompanying drawings includes a first part or receptacle 4 adapted to receive the medium to be contained, a second part or cap 5 adapted to slidingly yet substantially sealingly engage with the receptacle 4 and a valve means generally indicated at 6 included on the base of the receptacle 4, the valve 6 allowing air within the container to be expelled during engagement of parts 4 and 5, the valve means thereafter remaining closed until the after prescribed steps are followed to allow the valve means 6 to be manually over-ridden to vent the interior 7 of the container, defined by the combination of parts 4 and 5, to atmosphere.

It will be appreciated that when in the closed or partially closed configuration, any attempt to disengage cap 5 from receptacle 4 with the valve means 6 in the closed position creates a vacuum and such an attempt is accordingly resisted by atmospheric pressure. Thus before access may be gained to the interior 7 of the container, the valve means 6 must be over-ridden venting the interior 7 to atmosphere, and allowing cap 5 to be withdrawn from the receptacle 4 relatively easily.

As can be seen from the drawings, the receptacle 4 and cap 5 comprise cylindrical tubular members with closed ends 8 and 9 respectively. A portion 10 of the outer surface of the receptacle 4 corresponds substantially in diameter with the inner surface 11 of the cap 9 although there is some clearance provided as depicted at 12 to allow an easy sliding action between the two components.

In order that an efficient seal be provided between components 4 and 5, which is necessary for the apparatus to function properly, and still ensure that not too great a degree of resistance to sliding is provided which would make the apparatus difficult to manipulate by an aged or infirmed person, a seal 13 is provided about the open rim 31 of the receptacle 4. The seal 13 may be of any conventional form and is preferably a rubberised seal.

As can be seen from FIGS. 1 and 2, the receptacle 4 includes on the outer surface thereof a band 14 of greater diameter than the portion 10 and a further peripheral rib 15 of a diameter intermediate to those of the portions 10 and 14 respectively, the rib 15 being coincident with the base 8 of the receptacle 4 and having a purpose as hereinafter described. The portion 14 on the receptacle 4 of the container ensures that a substantially straight, parallel sided container is formed.

In the embodiment depicted and described, the valve means 6 is provided in the form of a rectangular sealing pad 16 acting on a rectangular seat 17 of lesser dimensions, the seat being formed by an orifice in the base 8 of the receptacle 4. The sealing pad 16 is rigidly attached to pivot arm 18, the arm pivotting on axle 19 which passes through the pivot arm 18 in a plane parallel to the plane of the arm, the axle 19 being retained in pivot blocks 20*a* and 20*b* formed integrally with the base 8 of the receptacle 4. A small leaf spring 21 is provided acting between the base 8 and the pivot arm 18 on that side of the axle 19 remote from the sealing pad 16 to thus bias the pad 16 onto its seat 17 and retain the valve in the closed position when not subjected to over-riding. It will be appreciated that the tension of the spring 21 must be such as to normally retain the sealing pad 16 on its base 17 yet allow the pad to be displaced from the seat when subjected to the pressure of air being expelled from within the container when the container is being closed.

As indicated hereinabove, it is preferable that a triggering means be provided which ensures that the valve means 6 may only be over-ridden to vent the interior 7 of the container to atmosphere when the triggering means is placed in a particular configuration.

Accordingly a triggering component 22 is provided comprising a circular base portion 23, having an upwardly extending skirt 24 projecting from the periphery thereof, the outer edge of the skirt 24 having an inwardly extending lip 25. In this preferred embodiment, the base portion 23 with integral skirt 24 and lip 25 are formed from a relatively resilient plastics material such that the triggering component 22 is fitted to the base portion of the receptacle 4 by stretching the upper lip 25 and skirt 24 outwardly and passing the same over the extended lip 15 provided around the base 8 of the receptacle 4. By ensuring that the stretching is within the elastic limits of the component 22 the same assumes its original form and portion 22 is thereafter retained about the base of the first part 4 by engagement of the lip 25 with the rib 15. However, the triggering component 22 is, when fitted, rotatable and telescopic with respect to the receptacle 4.

The fit of the triggering component to the base of the receptacle is not a sealed fit and thus air being expelled from the interior 7 of the container through the valve means 6 may escape to atmosphere through the joint between the triggering means 22 and receptacle 4. Likewise when the valve means is over-ridden to allow air to pass into the interior of the container, the passage of air may take the same route.

In addition, or alternatively, apertures may be formed in the base 23 and/or skirt 24 of the triggering component 22 to provide a more direct route for air passing between the valve means 5 and the atmosphere surrounding the container. Such apertures are exemplified by reference numeral 33 in FIG. 1.

Attached to the circular base portion 23 of the triggering component 22 is a trigger block 26, the trigger block 26 being a small disc integrally formed with the base portion 23 and being positioned on the base at a radius from the centre point of the base such that when the base component 23 is rotated so that the trigger block 26 lies above the pivot arm 18, the trigger block 26 lies above that portion of the pivot arm on the side of the pivot axis remote from the sealing pad 16 thus when the triggering means is telescoped toward up and over the base 8 of the receptacle, the trigger block 8 engages the pivot arm 18 and causes the same to rotate about axle 19 to lift the sealing pad 16 off its seat 17 thus venting the interior 7 of the container to atmosphere. The triggering component is configured so that only when the trigger block 25 is aligned with the pivot arm 18, can the valve means 6 be over-ridden, telescoping the triggering means toward the receptacle 4 in all other positions will have no effect whatsoever on the valve means.

The container may include indicating means such as marked grooves 28 and 29 on the triggering component 22 and receptacle 4 respectively. The grooves 28 and 29 being so positioned on their respective components so that when the trigger block 26 lies above the pivot arm 18, the marks 28 and 29 are substantially aligned. Such grooves should, of course, be of a discrete form so as not to attract the attention of infants. As an alternative, the dies from which the components of the present container were manufactured could be so designed as to leave casting ribs corresponding to marks 28 and 29 i.e. by aligning the casting ribs on each component the trigger block 26 would lie above the pivot arm 18.

Leaf or coil springs 27 are further provided to normally bias the triggering componet 22 away from the receptacle 4 until the lip 24 engages with the rib 15.

All components of the invention may be moulded from any suitable plastic material.

The use of the invention is as follows:

Starting at a point where the cap 5 is separated from the receptacle 4 including triggering component 22 and valve means 6, the medium to be contained for example pills, tablets or the like are placed in the space defined by the inner walls of the receptacle 4.

The cap 5 is then aligned with, and slid over, the receptacle whereupon air contained within the space 7 defined by the inner walls of the receptacle, the upper edge 32 of the sealing ring 13 and the base and any part of the inner wall 11 of the cap above the sealing ring, is displaced through the valve means 6. In the entire operation of closing the container, the total volume displaced through the valve means 6 is substantially the difference in volume between the volume of the space 7 when the rim 30 of the second part is first engaged with the rim 31 of the first part and that when the container is in the fully closed position (as depicted in FIG. 2). Once the fully closed position or indeed any partially closed position has been reached the valve flap 16 is biassed onto its seat by the action of the spring 21 and any attempt to subsequently disengage the second portion from the first portion will seek to lower the pressure of air in space 7 below atmospheric and will thus be opposed by the surrounding atmosphere.

When it is desired to gain access to the interior of the container the triggering component 22 is rotated until mark 29 on the skirt 24 thereof coincides with mark 30 on the portion 14 of the receptacle 4. As described hereinabove, this position indicates that the trigger block 26 is in position above the pivot arm 18 of the valve means 6. In this position the triggering component 22 is telescoped upwardly, over the base of the receptacle 4 whereupon the trigger block 26 coacts with the pivot arm 18, pivotting the same about axle 19 and lifting the sealing pad 16 off its seat 17 and venting the interior 7 of the container to atmosphere. The portion 5 may then be slid from engagement with the portion 4, the only resistance to this sliding being the minor resistance offered by the sealing ring 13.

It will be appreciated to those skilled in the art that the valve means 6 might be provided alternatively in the second part 5 and need not be of the configuration specifically hereindescribed, the only requirement being that the valve means 6 provide a one way type action in normal use but being over-ridable when desired.

What is claimed is:

1. A container comprising: a first part or receptacle; a second part or cap; said first part and said second part being sealingly associable to define an enclosed container space; valve means included in said first or said second part adapted to allow expulsion of air from said enclosed space upon association on said first and said second parts, but not normally allow passage of air into said enclosed space; means included within said first or second part actuable to vent said enclosed space to the atmosphere surrounding said container.

2. A container as claimed in claim 1 wherein said means actuable to vent said enclosed space is included within said valve means and in use, serves to over-ride said valve means.

3. A container as claimed in claim 2 wherein said valve means in included within said first part.

4. A valve means as claimed in claim 2 wherein said valve means is included within said second part.

5. A container as claimed in claim 4 wherein said container further includes triggering means adapted to allow actuation of said means to over-ride said valve means only when said triggering means is placed in a predetermined position or configuration.

6. A container as claimed in claim 4 wherein said container further includes triggering means adapted to allow actuation of said means to over-ride said valve means only when said triggering means is placed in a predetermined position or configuration.

7. A container comprising a first part or receptacle; a second part or cap; said first part and said second part being slidingly and sealingly associable to define an enclosed container space; valve means being automatically actuated upon association of said first part with said second part to allow expulsion of air from said enclosed space, said valve means only allowing the passage of air into said enclosed space when over-ridden.

8. A container as claimed in claim 7 wherein said first and second parts are cylindrical members each having one end closed.

9. A container as claimed in claim 8 wherein said valve means comprises: a pad member sealing on an orifice within said first or second parts; a pivot arm being rigidly attached to said pad member at one end thereof and being biassed in a manner such that said sealing pad is constrained toward said seat, whereupon in use to over-ride said valve means said pivot arm is displaced against the bias thus raising said sealing pad off said seat.

10. A container as claimed in claim 9 wherein said container further includes triggering means adapted to allow actuation of said means to over-ride said valve means only when said triggering means is placed in a predetermined position or configuration.

11. A container as claimed in claim 10 wherein said valve means is included within said first part.

12. A valve means as claimed in claim 10 wherein said valve means is included within said second part.

13. A container as claimed in claim 11 wherein said triggering means comprises a circular disc having a peripheral skirt, said peripheral skirt coacting with the base of said first part and being rotatable and telescopic with respect thereto, said circular disc including a trigger block which, in use, may be aligned with said pivot arm whereupon the action of telescoping said triggering component toward said first part brings said trigger block into contact with said pivot arm and over-rides said valve means.

* * * * *